US006128846A

United States Patent [19]

Walker et al.

[11] Patent Number: 6,128,846

[45] **Date of Patent: *Oct. 10, 2000**

[54] LENGTH SHOTGUN CHOKE TUBE

[75] Inventors: Ronald N. Walker, Cobb; Gerald E. Poe, Black Earth; Larry Leutenegger, Albany, all of Wis.

[73] Assignee: Inpromark, Inc., Dodgeville, Wis.

[ * ] Notice: This patent issued on a continued prosecution application filed under 37 CFR 1.53(d), and is subject to the twenty year patent term provisions of 35 U.S.C. 154(a)(2).

[21] Appl. No.: 09/092,852

[22] Filed: Jun. 8, 1998

[51] Int. Cl.[7] ..... F41A 21/40

[52] U.S. Cl. ..... 42/79

[58] Field of Search ..... 42/79; 89/14.6

[56] References Cited

U.S. PATENT DOCUMENTS

| | | | |
|---|---|---|---|
| 85,949 | 1/1869 | McKenzie | 42/79 |
| 587,801 | 8/1897 | Durnford | 42/79 |
| 889,644 | 6/1908 | Szemerey | 42/79 |
| 1,858,560 | 5/1932 | Rosentiel | 42/79 |
| 2,092,649 | 9/1937 | Jung | 42/79 |
| 2,098,617 | 11/1937 | Cutts, Jr. | 42/79 |
| 2,447,205 | 8/1948 | Powell | 42/79 |
| 2,453,121 | 11/1948 | Cutts | 42/79 |
| 2,658,298 | 11/1953 | Oberfell | 42/79 |
| 2,811,901 | 11/1957 | Barr | 89/14 |
| 2,861,375 | 11/1958 | Rodick | 42/79 |
| 2,922,242 | 1/1960 | Packmayr et al. | 42/79 |
| 2,984,926 | 5/1961 | Havlin | 42/79 |
| 3,045,378 | 7/1962 | Denaux | 42/79 |
| 3,045,379 | 7/1962 | Cutts | 42/79 |
| 3,138,991 | 6/1964 | Malter | 42/79 |
| 3,161,979 | 12/1964 | Lowe | 42/79 |
| 3,400,661 | 9/1968 | Coon et al. | 42/79 |
| 3,427,648 | 2/1969 | Manning et al. | 102/93 |
| 3,492,750 | 2/1970 | Ashbrook et al. | 42/79 |
| 3,496,667 | 2/1970 | Lowry | 42/79 |
| 3,605,313 | 9/1971 | Kranz | 42/79 |
| 3,724,376 | 4/1973 | Kordas | 102/42 |
| 3,769,731 | 11/1973 | Packmayr et al. | 42/79 |
| 3,797,155 | 3/1974 | Smith et al. | 42/79 |
| 3,812,610 | 5/1974 | Kranz | 42/79 |
| 4,008,538 | 2/1977 | Center | 42/78 |
| 4,040,331 | 8/1977 | Litman | 89/14 |
| 4,058,925 | 11/1977 | Linde et al. | 42/79 |
| 4,071,971 | 2/1978 | Tornas | 42/79 |

(List continued on next page.)

FOREIGN PATENT DOCUMENTS 997788 1/1952 France .

*Primary Examiner*—Charles T. Jordan
*Assistant Examiner*—Denise J Buckley
*Attorney, Agent, or Firm*—Hill & Simpson

[57] ABSTRACT

An improved shotgun choke tube or fixed shotgun shot choking system is provided in which the 3-dimensional tightness or compactness of the pattern is achieved by the placement of radial projections within the choke tube at a selected distance from the muzzle, dependent upon the length of the shotgun shell being used, in conjunction with varying the dimensions of the projections depending on the nature of the components used in the manufacture of the particular shotgun shell used and the pattern results desired. Widest patterns (which are narrower or tighter than without the use of the choke tube) are achieved when the projections are positioned adjacent to the muzzle and/or with radial projections of minimal area contacting the walls of the wad/cup to retard its exit from the muzzle. Progressively, tighter patterns are achieved by varying the dimensions and increasing the area of the projections coming onto contact with the wad/cup or by placing the radial projections rearwardly or inwardly from the muzzle by an amount of ½ of the length of the shot cup portion of the plastic wad/cup carrying the pellets, a full length of the cup portion, or even greater than the full length of the cup portion for maximum tightness. In all cases, length of the shot string is substantially shortened by use of the projections to retard the wad, causing more shot to arrive on target simultaneously, thereby both making the target easier to hit and providing greater striking energy on the target.

12 Claims, 2 Drawing Sheets

U.S. PATENT DOCUMENTS

| | | | |
|---|---|---|---|
| 4,151,671 | 5/1979 | McPeak | 42/79 |
| 4,711,048 | 12/1987 | Ashbrook | 42/79 |
| 4,713,903 | 12/1987 | Mainland | 42/79 |
| 5,157,211 | 10/1992 | Mossberg | 42/79 |
| 5,309,814 | 5/1994 | Mossberg | 89/14.6 |
| 5,452,535 | 9/1996 | See et al. | 42/79 |

LENGTH SHOTGUN CHOKE TUBE

BACKGROUND OF THE INVENTION

The present invention relates to shotgun shot choking systems in general and to removable choke tubes and in particular to individual and series of choke tubes having their length and internal dimensions specifically designed to provide a specific effect on shot pellets delivered by a shotgun.

Applicants are very familiar with the choke tube described in U.S. Pat. No. 5,452,535 which has an inventor common to this invention and which is assigned to the assignee of this application.

The choke tube, or retarding device disclosed in the '535 patent utilized a plurality of radial projections which extend inwardly of the bore of the shotgun barrel to engage a plastic shotgun shell shot wad/shot cup in order to permit the individual shot pellets carried by the shot cup to continue moving forward in an uninterrupted pattern while the wad/cup is retarded to cause it to lag behind the released pellets so as to not interfere with their pattern. This retarding device provided greatly improved shot patterns, that is, greatly increased the number of pellets contained within a given diameter and at any given distance from the muzzle of the shotgun.

At the time the application for the '535 patent was filed, it was believed that additional conditioning devices such as the shot spreader (FIG. 3) or the choke 72 or choke 86 (FIGS. 4–6) would need to be utilized in order to further adjust and fine tune the pellet pattern. While these additional devices have some influence on the pellet pattern, these additional devices usually did not tighten the pattern, but rather caused a dispersal of the pellet pattern, which is at times desired.

SUMMARY OF THE INVENTION

The present invention provides a further enhancement of the choke tube described in the '535 patent in a way that permits the user to control the three-dimensional size of the resulting pattern between the muzzle and the target without the use of additional add on components beyond the choke tube itself.

The present invention provides for a range of specific lengths between the retarding radial projections and the muzzle, or open end of the choke tube, and also provides for a range of dimensions for the retarding radial projections themselves. The specific length and radial projection dimensions to be selected are dependent upon four factors: 1) the length of the shotgun shell casing, 2) the length of the plastic wad/shot cup as measured from its internal cross wall to its forward end, 3) the nature of the components of the shotgun shell being used, such as wad dimensions, wad composition and toughness, shot hardness, shot diameter, and velocity of a given shotgun shell loading, and 4) the tightness of the pattern desired at any given range. The present invention permits a user to select a particular choke tube in order to achieve a desired pattern size, based upon the aforementioned factors, and at the same time to substantially shorten the length of the shot string at any given range from the muzzle, so as to concentrate the shot pattern three dimensionally to deliver more shot pellets on target at one time. A user may have a particular single use, such as a particular type of target practice, for example, trap shooting, in which the user wants a particular size shot pattern, and the shotgun shell size remains constant. In this case the user would select the particular choke tube having the appropriate dimensions for this particular use which will throw a tight pattern of the "full choke" pattern density. However, the user may have a variety of uses, wherein some uses benefit by a smaller pattern, such as in turkey hunting, and other uses benefit by a larger pattern, such as skeet shooting. In that case, the user would have a plurality or series of choke tubes (which are threaded onto the barrel of the shotgun), with each choke tube specifically designed to provide a certain pattern size for a certain use. This same system may also be permanently manufactured directly into the barrel when a particular single use is desired.

To achieve the varying size of the pellet pattern, the dimensions of the radial projections and also the distance of the radial projections from the muzzle is varied and changed. These dimensions are dependent on, and relative to, the length of the shotgun shell and of the shell's wad/shot cup and also upon the nature of the components of the shotgun shell to be used. To have the widest or most open pattern, the radial projections generally are provided immediately adjacent to the muzzle. In this manner the plastic shot cup will more closely follow and move with the pellets, even after the pellets have left the muzzle, in that the shot cup portion of the wad/cup will be projecting beyond the end of the muzzle virtually its entire length before the stiffer portion of the wad/cup engages the radial projections of the choke tube to retard the wad/cup. Thus, the petals of the shot cup will open more quickly and the emerging propellant gas and the shot cup will still interfere in some degree with the pellets and this disturbance will cause the pellets to slightly disperse. This dispersal, however, especially in regard to shot stringing length, will be significantly less than if no retarding device is present, and will also result in more evenly dispersed patterns and shorter shot strings.

To provide a somewhat tighter pattern, the radial projections are positioned inwardly from the muzzle so that the wad base will contact the projections when the cup portion is projecting approximately half way out of the muzzle. In this case, the shot pellets will have a chance to begin moving away from the shot cup before the cup leaves the muzzle and the interference between the shot cup and the pellets will be reduced.

For even tighter patterns, the projections are positioned further inwardly so that the wad base contacts the projections when the leading edge of the shot cup is approximately even with the muzzle. This permits the inertia of the shot pellets to carry them forward out of the muzzle with even lessee interference by the petals of the shot cup, thus resulting in a still further tightening of the shot pattern.

Finally, the tightest pattern will be achieved when the radial projections are positioned even further inwardly from the muzzle so that the wad base will contact the projections while the entirety of the shot cup is positioned in the barrel and before the leading edge of the shot cup reaches the muzzle. In this case, virtually all of the pellets will leave the shot cup, unhindered by the shot cup, and thus remain in a very tight column.

Also, in lieu of, in addition to or in combination with previously described varying of the length of the tube, if for example the composition of the plastic wad used in the shell is of very weak or very tough plastic, or of materials other than plastic, or if due to other shot shell component variants, the dimensions of the projections themselves may be varied as to height, length, width and angle so as to give the specific degree of wad retardation desired and to obtain the specific performance desired from that particular shell. In general, the smaller the area and height of the projection which comes into contact with any given wad, the wider the resulting pattern will be, and visa-versa.

DETAILED DESCRIPTION OF THE PREFERRED EMBODIMENTS

Figure 1:
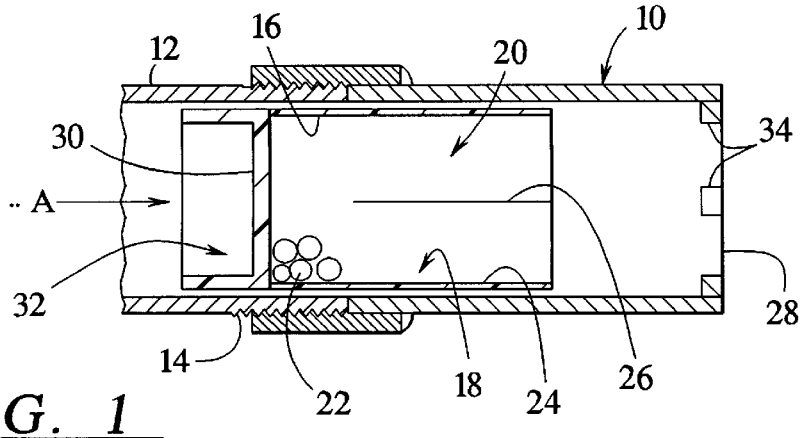
FIG. 1 is a longitudinal sectional view of a shotgun choke tube of the present invention, mounted on a shotgun barrel.

In FIG. 1 there is illustrated a shotgun choke tube 10 mounted onto a shotgun barrel 12. Although in the arrangement illustrated the choke tube 10 is attached to the barrel 12 by means of external threads 14 on the barrel and internal threads 16 on the choke tube 10, it is also known to attach choke tubes by means of internal threads on the shotgun barrel and external threads on the choke tube. Either method of attachment to the shotgun barrel is contemplated by the present invention. Further, the present invention also contemplates forming the radial retarding projections in the barrel of the shotgun itself. The following references and illustrates to "choke tube" shall include the barrel itself.

The choke tube 10 of the present invention is essentially of the type disclosed in U.S. Pat. No. 5,452,535, specification of which is incorporated herein by reference. This choke tube is to be used in conjunction with a plastic shot wad/shot cup 18, or other wads of other composition, which is provided within standard shotgun shells. This wad/cup has a forward chamber 20 within which are carried a plurality of individual shot pellets 22 which typically fill essentially the entirety of the forward chamber 20. The forward chamber is defined by a surrounding cylindrical wall 24 which has a plurality of longitudinal slits 26 which divide the thin wall 24 into a plurality of petals which open up once the wad/cup leaves a muzzle 28 or open end of the choke tube 10 to cause the wad/cup to quickly fall away due to friction with the air.

The wad/cup 18 has a lateral dividing wall 30 which separates the pellet chamber 20 from a powder chamber 32. When the shotgun is fired, there is a charge of gun powder contained within the powder compartment 32 which ignites and explosively expands to propel the wad/cup 18 and the pellets 22 carried therein toward the muzzle in the direction of arrow A. Typically when the choke tube is not utilized, the pellets 22 will remain within the wad/cup 18 as the wad/cup emerges from the muzzle of the gun. Once the wad/cup leaves the confinement of the barrel, the petals will peel open, causing the wad/cup to slow down, allowing the pellets 22 to exit out of the open forward end of the wad/cup, under their own inertia, to proceed toward the target. However, the wad/cup also becomes unstable immediately upon exiting the muzzle and this instability causes interference between the wad/cup and at least some of the pellets, thereby disturbing the column of pellets as they are moving forward relative to the wad/cup. Also, the wad by emerging from the muzzle too quickly allows propellant gas to escape and mix with the shot charge and exiting wad/cup. All of this causes an erratic, uneven radial disbursement of the pellets, resulting in a 3-dimensionally wider, longer and/or looser and less even pattern of the pellets at any given distance from the muzzle.

To overcome this problem, and to provide tighter patterns and shot strings, with more closely packed pellets, it was described in the '535 patent to provide radial projections 34 on the interior diameter of the choke tube to retard the wad/cup before it exits the muzzle 28. It was found that by retarding the wad/cup 18, the pellets were permitted to exit from the wad/cup relatively unimpeded and also the retardation of the wad/cup and propellant gases prevented it from blowing through the column of exiting shot pellets after they had left the wad/cup. Thus, the patterns produced by the choke tube of the '535 patent were much tighter, shorter evenly distributed and compact than without use of the choke tube.

The present invention provides a further improvement over the choke tube disclosed in the '535 patent relating to both the dimensions of the radial projections and also relating to the specific placement of radial projections 34 relative to the muzzle 28 and relative to a length L of the pellet chamber 20 of the wad/cup 18.

Figure 5:
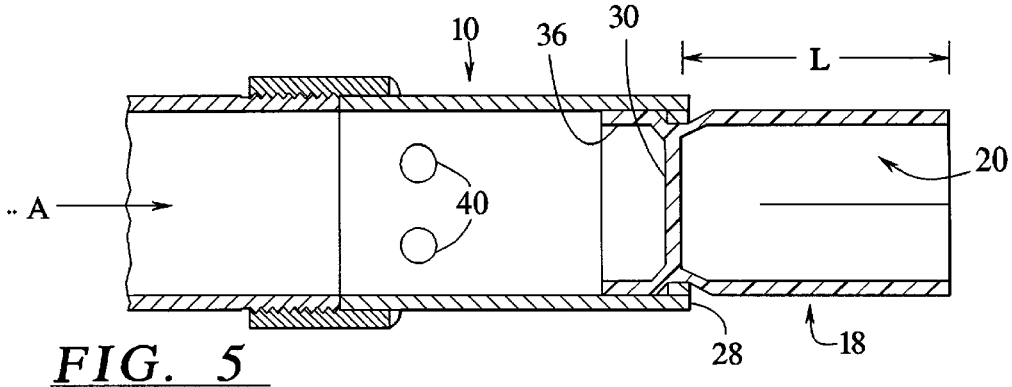
FIG. 5 is a longitudinal sectional view of the choke tube of FIG. 1 illustrating a shot wad/shot cup emerging from the choke tube.

In the first embodiment shown in FIG. 1, the radial projection 34 is positioned immediately adjacent to the muzzle 28. In this case, as shown in FIG. 5, the retardation of the wad/cup 18 will occur once the full length L of the forward chamber 20 has exited the muzzle 28. The stiffer lateral wall 30 and stiffer wall 36 of the powder chamber 32 will provide substantial retardation of the wad/cup 18 to permit the pellets to exit the wad/cup, seal the propellant gas within the bore, and produce a pattern 3-dimensionally much tighter than without the use of the choke tube 10.

As described in the '535 patent, gas ports 40 may be provided to provide a release of expanding gases from the barrel, thereby removing any accelerating force which might otherwise be applied to the wad/cup 18 as it approaches the muzzle.

Figure 2:
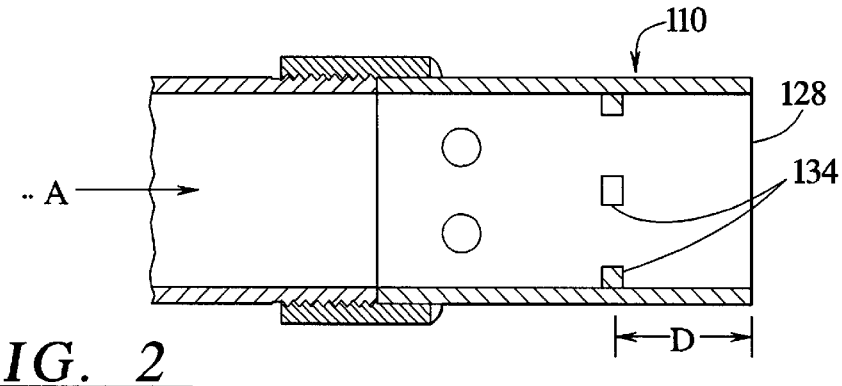
FIG. 2 is a longitudinal sectional view of a third embodiment of the shotgun choke tube of FIG. 1.
Figure 6:
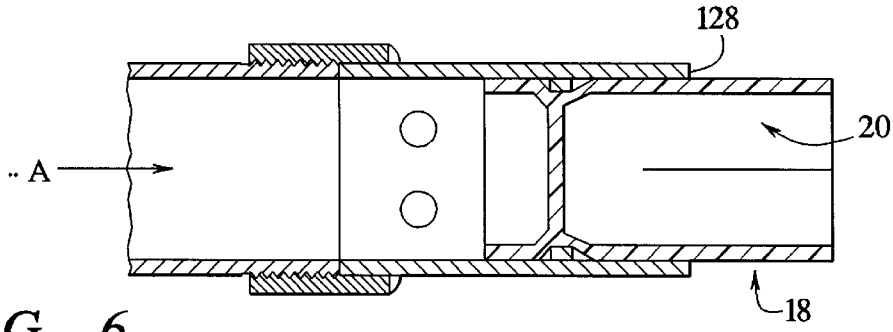
FIG. 6 is a longitudinal sectional view of the choke tube of FIG. 2 illustrating a shot wad/shot cup emerging from the choke tube.

FIG. 2 illustrates a second embodiment of a choke tube 110 which provides a tighter pattern as compared to the choke tube 10 of FIG. 1. In this embodiment, radial projections 134 are positioned a distance D rearward or inward of a muzzle 128. The distance D is approximately one half of the length L of the pellet chamber 20 of the wad/cup. As illustrated in FIG. 6, this placement causes substantial engagement and retardation to occur when the wad/cup has its pellet chamber 20 projecting approximately half way out of the muzzle 128. Such an arrangement prevents interference between the wad/cup and the exiting pellets to an even greater extent than the arrangement as shown in FIGS. 1 and 5, thus resulting in an even tighter pattern, that is, less radial disturbance of the individual pellets.

Figure 3:
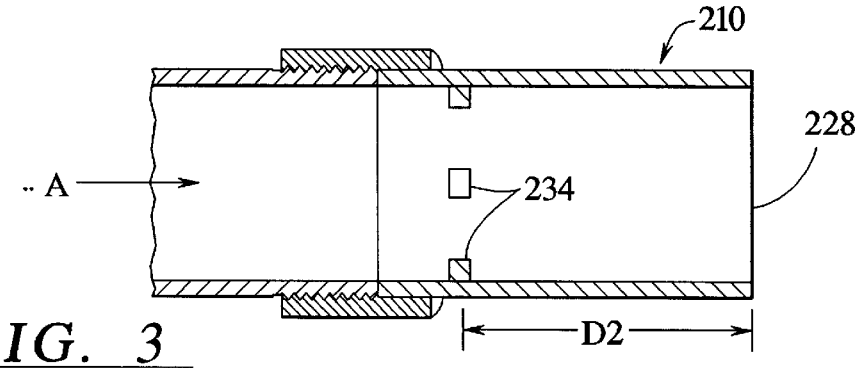
FIG. 3 is a longitudinal sectional view of a fourth embodiment of the shotgun choke tube of FIG. 1.
Figure 7:
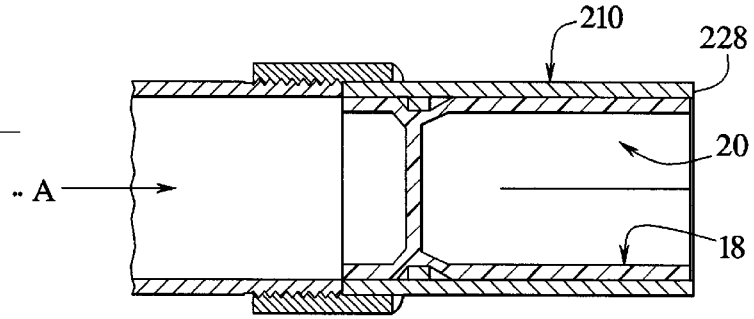
FIG. 7 is a longitudinal sectional view of the choke tube of FIG. 2 illustrating a shot wad/shot cup being retarded within the choke tube.

A further, tighter, pattern is achieved by utilizing a choke tube 210 as illustrated in FIG. 3. In this third embodiment, radial projections 234 are positioned a distance D2 rearward of a muzzle 228 of the choke tube. The distance D2 is approximately the full length L of the wad/cup. In operation, as illustrated in FIG. 7, this causes the wad/cup to be substantially engaged and retarded while the full length L of the pellet chamber is contained within the choke tube 210 and as a forward end of the wad/cup 18 is approximately flush with the muzzle 228.

Figure 4:
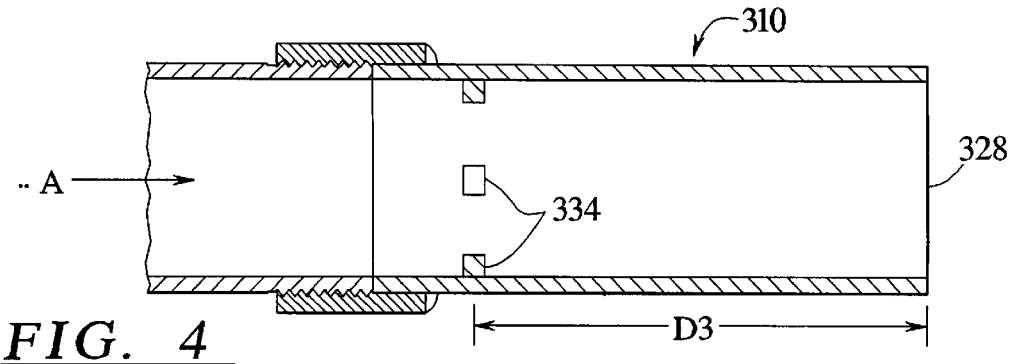
FIG. 4 is a longitudinal sectional view of an alternate embodiment of the shotgun choke tube of FIG. 1.
Figure 8:
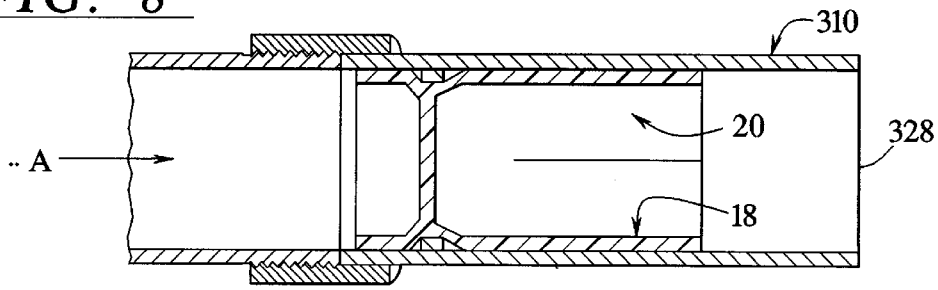
FIG. 8 is a longitudinal sectional view of the choke tube of FIG. 2 illustrating a shot wad/shot cup being retarded within the choke tube.

A further tightening of the pattern can be provided by utilizing a choke tube 310 as illustrated in FIG. 4. In this embodiment radial projections 334 are positioned a distance D3 rearward of a muzzle 328. The distance D3 is greater than the full length L of the forward chamber 20 of the wad/cup 18. As illustrated in FIG. 8, this will cause substantial engagement and retardation of the wad/cup while a forward end of the wad/cup is positioned well inward of the muzzle 328 of the choke tube 310.

Although exhaust ports are not illustrated with respect to FIGS. 3 and 4, they could be provided, so long as they are positioned sufficiently rearward of the muzzle to permit the wad/cup 18 to pass the openings before being fully discharged from the muzzle. Thus, the openings could be positioned upstream or downstream of the projections.

Standard production shotgun shells of the various gauges or diameters come in different lengths, for example, 2¾", 3" and 3½". The plastic wad/cups in those shotgun shells, and, in particular, the length of the pellet chamber varies for the different length of shotgun shells and, in particular, the length of the pellet chamber varies for the different length of shotgun shells and for the composition of the shot used, e.g., lead, steel, tungsten, bismuth, ceramic. The length of the wad/cups however, is standardized and the following chart identifies the approximate lengths of the standard wad/cups columns of the major manufacturers:

| SHOTGUN SHELL LENGTH | WAD/CUP PELLET CHAMBER LENGTH |
|---|---|
| 2¾" | 1⅝"–1¾" |
| 3" | 1⅝"–1 15/16" |
| 3½ | 2"–2¼" |

Thus, in use, a user can select a particular choke tube to provide a degree of tightness for the pattern of pellets by selecting a choke tube in which the radial projections are spaced in appropriate distances from the muzzle to provide the desired result as outlined above in accordance with the length of shotgun shell being used.

Also, the user can control and fine tune pattern results by varying selection of the height, width, length and shape dimensions of the radial projections of any particular tube so as to best conform it with the composition of the particular brand of ammunition or ammunition components used. Generally, the smaller the area and height which comes in contact with the cup/wad, the more open the pattern. For example, the radial height of the projections can range between 6/1000 inches and 20/1000 inches. The length of the projections can range between 10/1000 and 300/1000 inches and the angular width of each projection can range between 20/1000 and 300/1000 inches. The number of projections spaced around the inner circumference can also vary throughout a range of three to eight projections. A series of choke tubes will provide a full range of pattern tightness and control for the user.

Although in the figures of this application, a plurality of relatively rectangular radial projections are illustrated, the present invention contemplates use of all of the various types of radial projections as described in the '535 patent.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

We claim as our invention:

1. A choke tube for use with a shotgun and a shotgun shell in which shot pellets are carried in a shot wad/shot cup in which the shot cup portion has a predetermined length, comprising:

a cylindrical tube having a shotgun barrel attachment portion at a proximal end, an internal diameter sized to receive the shot wad/shot cup, and a distal muzzle, and a plurality of radial projections extending into said internal diameter a distance in the range 6/1000 inches to 20/1000 inches, said projections having a side adjacent said muzzle being essentially flush with said muzzle and having a side opposite said muzzle being longitudinally spaced from said muzzle, said projections having an angular width, measured along a line perpendicular to a centerline of said tube in a range of 20/1000 inches to 300/1000 inches and a length within said tube a distance in a range of 10/1000 inches to 300/1000 inches.

2. A set of gun choke tubes useable with a gun shell having shot pellets carried in a shot wad/shot cup in which the shot cup portion has a predetermined length, each gun choke tube comprising:

a hollow tube having a gun barrel attachment portion opposite a pellet exit end;

a plurality of internal projections extending from an internal surface of the hollow tube a distance in the range of 6/1000 inches to 20/1000 inches, said projections having an angular width, measured along a line perpendicular to a centerline of said tube in a range of 20/1000 inches to 300 inches and a length within said tube a distance in a range of 10/1000 inches to 300/1000 inches; and a first gun choke tube of the set of gun choke tubes having the internal projections spaced away from the pellet exit end a distance of at least approximately one half of said length of said shot cup portion and a second gun choke tube of the set of gun choke tubes having the internal projections positioned essentially adjacent said pellet exit end, the first gun choke tube having a tighter shot pellet pattern at a given distance past the pellet exit end than the second gun choke tube.

3. A choke tube for use with a shotgun and a shotgun shell in which shot pellets are carried in a shot wad/shot cup in which the shot cup portion has a predetermined length, comprising:

a cylindrical tube having a shotgun barrel attachment portion at a proximal end, an internal diameter sized to receive the shot wad/shot cup, and a distal muzzle, and a plurality of radial projections extending into said internal diameter a distance in the range of 6/1000 inches to 20/1000 inches, said projections being spaced from said muzzle a distance approximately one half of said shot cup portion length, said projections having an angular width, measured along a line perpendicular to a centerline of said tube in a range of 20/1000 inches to 300/1000 inches and a length within said tube a distance in a range of 10/1000 inches to 300/1000 inches.

4. A choke tube for use with a shotgun and a shotgun shell in which shot pellets are carried in a shot wad/shot cup in which the shot cup portion has a predetermined length, comprising:

a cylindrical tube having a shotgun barrel attachment portion at a proximal end, an internal diameter sized to receive the shot wad/shot cup, and a distal muzzle, and a plurality of radial projections extending into said internal diameter a distance in the range of $^{6}/_{1000}$ inches to $^{20}/_{1000}$ inches, said projections being spaced from said muzzle a distance approximately one half of said shot cup portion length, said projections having an angular width, measured along a line perpendicular to a centerline of said tube in a range of $^{20}/_{1000}$ inches to $^{300}/_{1000}$ inches and a length within said tube a distance in a range of $^{10}/_{1000}$ inches to $^{300}/_{1000}$ inches.

5. A choke tube for use with a shotgun and a shotgun shell in which shot pellets are carried in a shot wad/shot cup in which the shot cup portion has a predetermined length, comprising:

a cylindrical tube having a shotgun barrel attachment portion at a proximal end, an internal diameter sized to receive the shot wad/shot cup, and a distal muzzle, and a plurality of radial projections extending into said internal diameter a distance in the range of $^{6}/_{1000}$ inches to $^{20}/_{1000}$ inches, said projections being spaced from said muzzle a distance approximately one half of said shot cup portion length, said projections having an angular width, measured along a line perpendicular to a centerline of said tube in a range of $^{20}/_{1000}$ inches to $^{300}/_{1000}$ inches and a length within said tube a distance in a range of $^{10}/_{1000}$ inches to $^{300}/_{1000}$ inches.

6. A set of gun choke tubes according to claim 5, wherein said first gun choke tube has the internal projections spaced away from the pellet exit end between approximately a half length of said shot cup portion and a full length of said shot cup portion.

7. A set of gun choke tubes according to claim 5, wherein said first gun choke tube has the internal projections spaced away from the pellet exit end approximately a full length of said shot cup portion.

8. A set of gun choke tubes according to claim 5, wherein said first gun choke tube has the internal projections spaced away from the pellet exit end more than a full length of said shot cup portion.

9. A set of gun choke tubes useable with a gun shell having shot pellets carried in a shot wad/shot cup in which the shot cup portion has a predetermined length, each gun choke tube comprising:

a hollow tube having a gun barrel attachment portion opposite a pellet exit end;

a plurality of internal projections extending from an internal surface of the hollow tube a distance in the range of $^{6}/_{1000}$ inches to $^{20}/_{1000}$ inches, said projections having an angular width, measured along a line perpendicular to a centerline of said tube in a range of $^{20}/_{1000}$ inches to 300 inches and a length within said tube a distance in a range of $^{10}/_{1000}$ inches to $^{300}/_{1000}$ inches; and a first gun choke tube of the set of gun choke tubes having the internal projections spaced away from the pellet exit end a distance of approximately one half of said length of said shot cup portion and a second gun choke tube of the set of gun choke tubes having the internal projections spaced away from the pellet exit end a distance greater than approximately one half of said length of said shot cup portion said pellet exit end, the second gun choke tube having a tighter shot pellet pattern at a given distance past the pellet exit end than the first gun choke tube.

10. A set of gun choke tubes according to claim 9, wherein said second gun choke tube has the internal projections spaced away from the pellet exit end between approximately a half length of said shot cup portion and a full length of said shot cup portion.

11. A set of gun choke tubes according to claim 9, wherein said second gun choke tube has the internal projections spaced away from the pellet exit end approximately a full length of said shot cup portion.

12. A set of gun choke tubes according to claim 9, wherein said second gun choke tube has the internal projections spaced away from the pellet exit end more than a full length of said shot cup portion.

* * * * *